United States Patent [19]

Tsutsui et al.

[11] 4,248,201

[45] Feb. 3, 1981

[54] MOLDED IGNITION DEVICE

[75] Inventors: Mitsukuni Tsutsui, Nakamachi; Takashi Yoshinari, Katsuta; Toshiaki Iikubo, Hitachi; Kazuhiko Kawakami; Noboru Sugiura, both of Katsuta, all of Japan

[73] Assignee: Hitachi, Ltd., Japan

[21] Appl. No.: 946,859

[22] Filed: Sep. 29, 1978

[30] Foreign Application Priority Data

Sep. 30, 1977 [JP] Japan ..... 52-116769

[51] Int. Cl.[3] ..... F02P 3/04

[52] U.S. Cl. ..... 123/647; 123/634

[58] Field of Search ..... 123/148 D, 148 R, 148 E; 336/96

[56] References Cited

U.S. PATENT DOCUMENTS

| | | | |
|---|---|---|---|
| 2,462,491 | 2/1949 | Hallett | 123/148 D X |
| 3,260,299 | 7/1966 | Lister | 123/148 E |
| 3,395,684 | 8/1968 | Minks | 123/148 D |
| 3,902,471 | 9/1975 | Brungsberg | 123/148 E |
| 3,941,112 | 3/1976 | Habert | 123/148 D X |
| 4,099,510 | 7/1978 | Perrier et al. | 123/148 D |
| 4,195,611 | 4/1980 | Worz et al. | 123/148 E X |
| 4,198,943 | 4/1980 | Worz | 123/148 E X |

*Primary Examiner*—Tony M. Argenbright

*Attorney, Agent, or Firm*—Craig and Antonelli

[57] ABSTRACT

In a molded ignition device, an ignition coil with primary and secondary coils is molded with synthetic resin. A metal casing is mounted on the outer surface of the molded coil. A microelectric circuit such as an IC circuit is disposed in the space defined by the casing and the outer surface of the molded coil.

13 Claims, 10 Drawing Figures

MOLDED IGNITION DEVICE

The invention relates to an ignition device for an internal combustion engine and, more particularly, the one in which an amplifier is attached to an ignition coil molded with synthetic resin.

A remarkable progress of semiconductor technology enables an amplifier section in the ignition device to be fabricated into an integrated circuit form and thus to be small in size and light in weight. This fact permits the amplifier section to be attached to the ignition coil section.

When the amplifier is attached to the ignition coil, wiring and mounting work are remarkably simplified. The ignition coil molded with synthetic resin is superior to the ignition coil sealed in a metal case in that its size is small, its weight is light and it is substantially vibration proof. It is for this reason that it has been desired that the amplifier section be mounted with the ignition coil molded with synthetic resin.

The ignition coil emits a large amount of heat when it is operated. Semiconductor devices and elements used in the amplifier section are sensitive to heat, so that amplifier performance deteriorates with its ambient temperature rise. Therefore, when the amplifier is mounted with the ignition device, some measures must be taken to impede heat transfer from the ignition coil to the amplifier. Particularly, in the case of the ingition coil molded with synthetic resin, heat radiation from the ignition coil is poor and thus temperature rise of the ignition coil is remarkable. Accordingly the amplifier section attached to the ignition coil is greatly and adversely influenced by the heat from the ignition coil.

Accordingly, an object of the invention is to provide an ignition device for internal combustion engine in which a circuit section associated with the ignition device is attached to the ignition coil molded with synthetic resin in such a manner to be relatively free from thermal influence.

In the invention, a mounting section for mounting an amplifier including an electronic circuit such as an integrated circuit attached to a casing and the casing made of good thermal conduction material, together with an ignition coil section, are molded into a unitary form by using synthetic resin. The integrated circuit is disposed in a space defined by the mounting section and the casing. Another space formed between the surface of the ignition coil and the integrated circuit is used to prevent heat evolved from the ignition coil section from being transferred to the integrated circuit.

Other objects and features of the invention will be apparent from the following description taken in connection with the accompanying drawings, in which.

Figure 1:
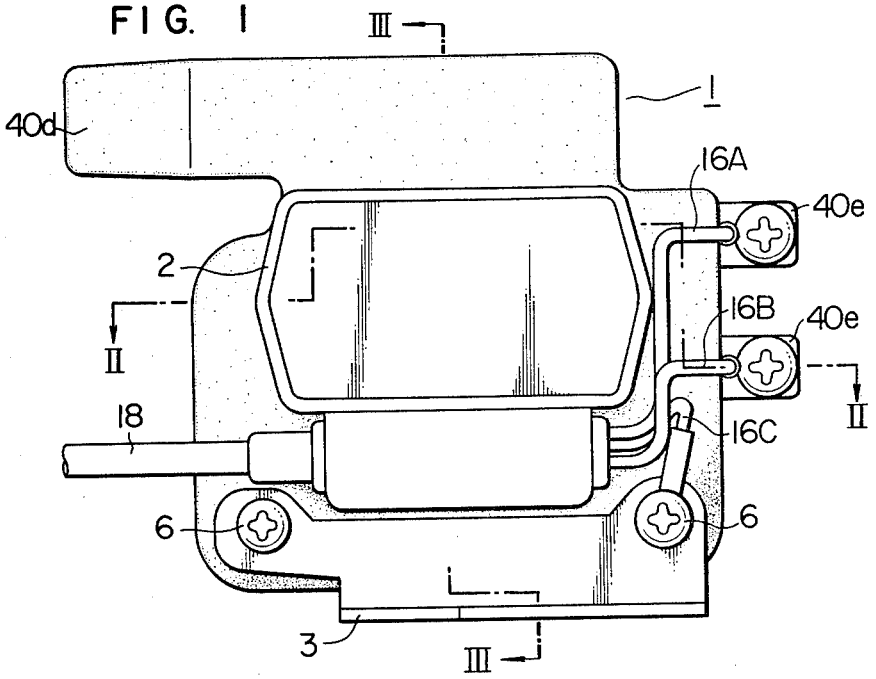
FIG. 1 shows a front view of a molded ignition device according to the invention.

In a front view of a molded ignition device shown in FIG. 1, a molded ignition coil section 1 is provided with a high voltage terminal 40*d* for taking out a high voltage supplied to an ignition plug, a circuit section 2 and a primary coil terminal 40*e*. The circuit section 2 includes a lead wire 18 for carrying a signal representing an ignition timing, lead wires 16A and 16B for feeding current to the primary winding, and lead wire 16C for earthing. The lead wires 16A and 16B are connected to the primary terminal 40*e* of the ignition coil. The molded ignition coil section 1 is further provided with stays for mounting the ignition coil section 1 to a car body.

Figure 2:
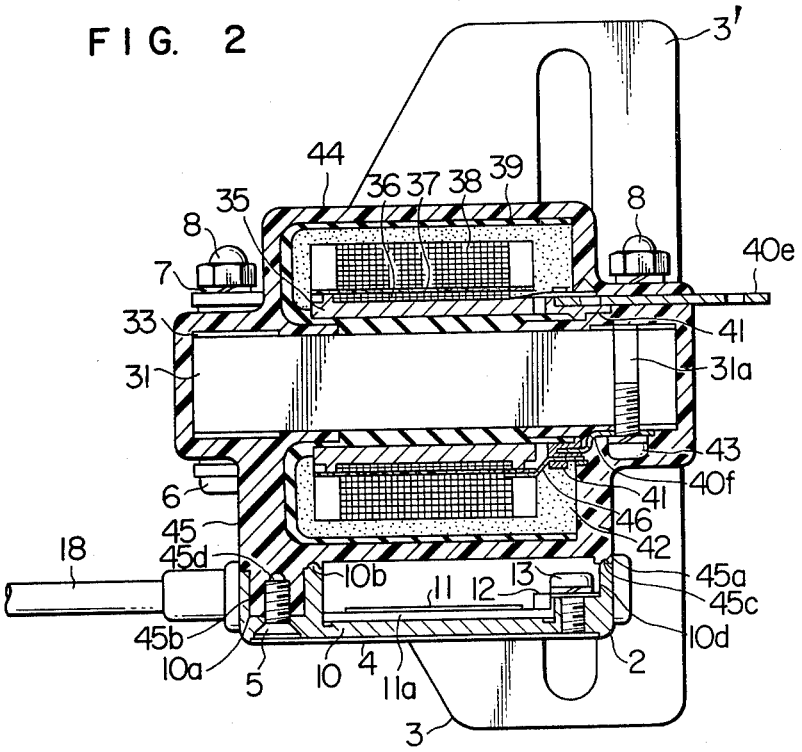
FIG. 2 shows a cross sectional view of the ignition device taken on line II—II in FIG. 1.
Figure 3:
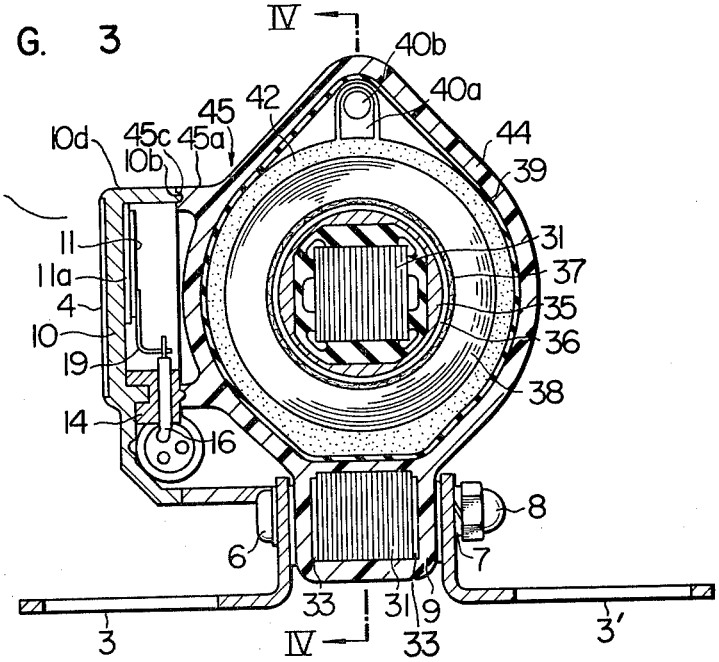
FIG. 3 shows a cross sectional view of the ignition device taken on line III—III in FIG. 1.
Figure 4:
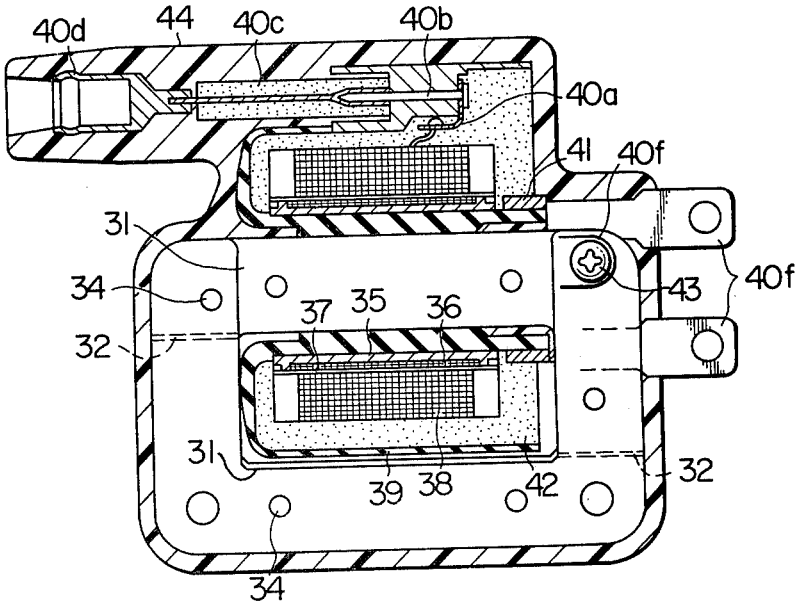
FIG. 4 shows a cross sectional view of the ignition device taken on line IV—IV in FIG. 3.

The details of the inside of the molded ignition device are shown in FIGS. 2 to 4. An iron core 31 of the ignition coil section 1 is comprised of a pair of L-shaped silicon steel plates multilayered which are coupled to each other by means of supporting plates of non-magnetic material such as stainless steel so as to form a closed magnetic path of iron core through gaps 32 each of about 0.5 mm for restricting a magnetic flux. These are fixed by rivets into a unitary form.

Wound around the bobbin 35 are a primary coil 36, a shield paper 37 of kraft paper aluminum-deposited and a secondary coil 38 in this order from the bobbin outer surface. These are housed in a case 39 made of insulating material such as synthetic resin and rubber. Both ends of the primary coil 36 are connected to the primary terminal 40*e*. The winding start end of the secondary coil 38 is connected to an earth lead wire 46 soldered or made to be bonded to the shield paper 37 by means of conductive cement. The other end of the secondary winding is connected to a high voltage relaying terminal 40*a*. The earth lead 46 is soldered at the other end to the earth terminal 40*f*. The primary terminal 40*e* and the earth terminal 40*f* are fixed by pressure to a terminal support 41 fitted to the wall at the center of the case 39.

A high voltage relaying terminal 40*a* is connected to a high voltage needle shaped nail 40*b* which is pressure fitted to the case 39.

After such an assembling, epoxy resin 42 is vacuum-injected into the case 39 and thus the primary and secondary coils 36 and 38 are insulated and the terminal support 41, the primary terminal 40*e*, the earth terminal 40*f* are firmly fixed by the epoxy resin.

After injecting of the epoxy resin, the iron core 31 is inserted into the central hole of the case 39 and, as described above, is assembled by using stiffening plates 33 and rivets 34. The earth terminal 40*f* is mounted around the open end of a hole 31*a* previously made through the iron core 31 by means of a screw 43 and is earthed to the iron core 31.

The high voltage needle 40*b* is connected to the high voltage terminal 40*d* through a high voltage lead 40*c*. These parts are integrally molded with synthetic resin such as polybutylene terephthalate containing glass fiber of 10 to 20%. A mounting portion 45, including an outer frame 45*a* and a boss 45*b*, of an amplifier section 2 is formed when the ignition coil section 1 is integrally molded with the synthetic resin. A groove 45*c* extending along the inside of the boss 45*b* is formed on the top end of the outer frame 45*a*. A hole 45*d* is formed at the center of the boss 45*b*. The amplifier section 2 includes an electronic circuit 11 fabricated in integrated circuit fashion housed in a casing 10 made of conductive material such as aluminum.

Figure 5:
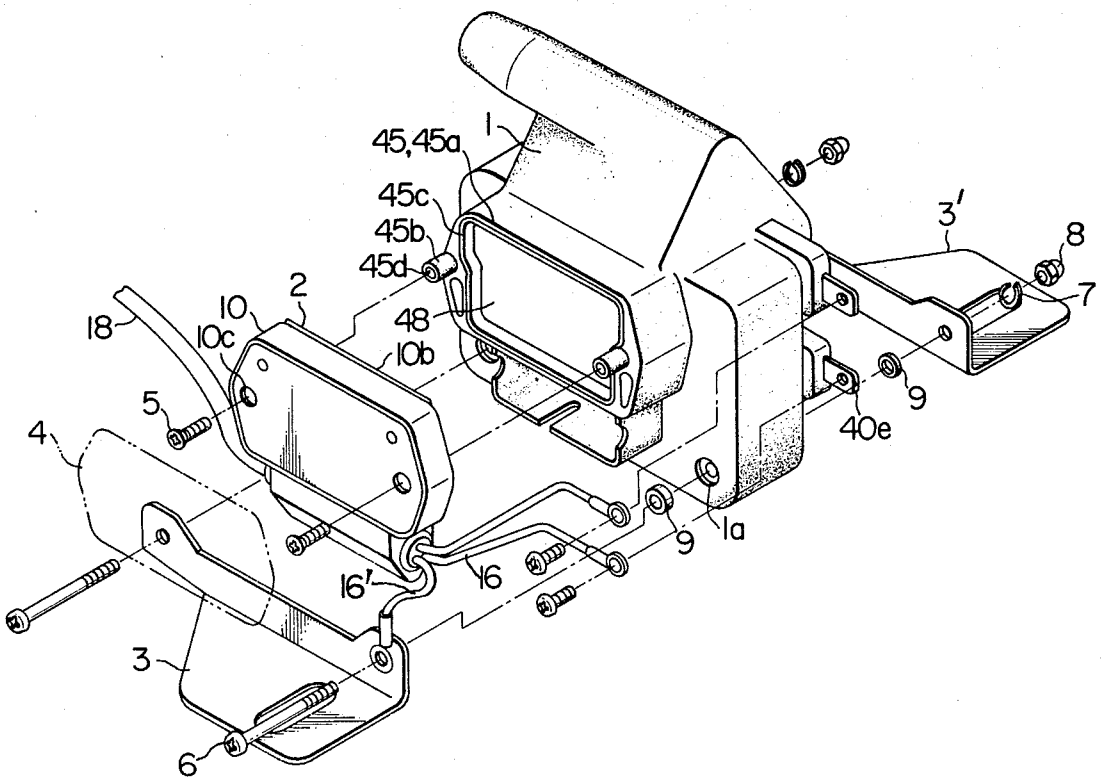
FIG. 5 shows an exploded view of the molded ignition device.
Figure 6:
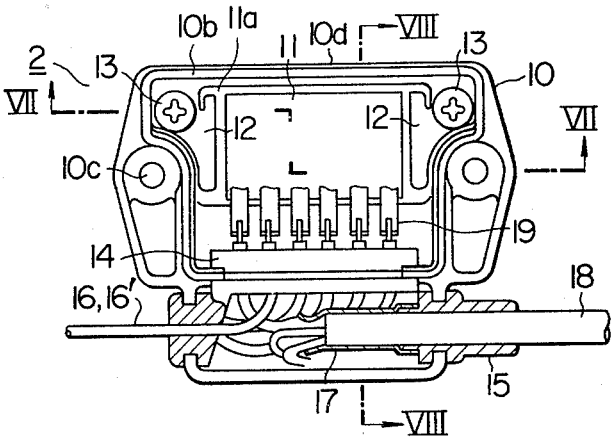
FIG. 6 shows a plan view of a circuit section used in the ignition device.
Figure 7:
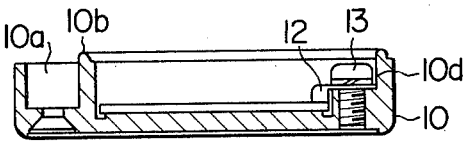
FIG. 7 shows a cross sectional view of the circuit section taken on line VII—VII in FIG. 6.
Figure 8:
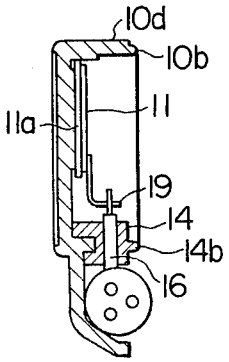
FIG. 8 shows a cross sectional view of the circuit section taken on line VIII—VIII in FIG. 6.

Referring now to FIG. 5, there are shown the casing 10, the stay 3 and the like in exploded form. FIG. 6 shows a plan view of the casing 10 and its cross sectional views are illustrated in FIGS. 7 and 8. The integrated circuit 11 is made to be bonded to a heat sink 11*a* by soft bond of silicon. The heat sink 11*a* is fixed onto the bottom enclosed by the outer frame 10*d* of the casing 10 by means of plate springs 12, screws 13 and silicon bond with good thermal conduction. The input and output terminals of the integrated circuit chip are connected to terminals 19 integral with the integrated circuit. The earth of the integrated circuit 11 is soldered to the terminal 19 and the heat sink 11*a*. The casing 10 also is electrically connected to the heat sink 11*a* by the plate springs 12 and the screws 13 and is sustained at ground potential. Although not shown, the integrated circuit 11 includes elements with large collector loss such as output transistors.

A projection 10*b*, extending along the inside of a concave portion 10*a* with a counter sink 10*c*, is formed on the top end of the outer frame 10*d* of the casing 10. A bushing 14 made of resilient material such as rubber is fitted into a cut-away portion of the projection 10*b*. The bushing 14 is provided with a projection 14*b* with the same shape as the projection 10*b* of the casing 10. To the terminal 19 of the integrated circuit 11 are soldered one ends of lead wires 16, 16' and 18, through the bushing 14. The other end of the lead wire 16 is fastened to the primary terminal 40*e* of the ignition coil by a screw. The other end of the lead wire 16' is also fastened to the stay 3 of the ignition coil section 1 by a screw. The lead wire 18, which is a shielded wire, is connected at the other end to the ignition signal generating unit (not shown).

A part of the bushing 14 is fitted into a portion through which lead wires 16A to 16C are taken out from the casing 10. A bushing 15 of insulating material is fitted in a portion through which the lead wire 18 is taken out.

The amplifier section 2 is mounted onto the mounting portion 45 of the ignition coil section 1 in the following manner. The projection 10*b* provided on the outer frame 10*d* of the casing 10 is fitted into the groove 45*c* formed to the outer frame 45*a* of the mounting portion 45 and the boss 45*b* is fitted into the hole 10*a*. Then, these are fixed by tapping screws 5 from the outside of the casing 10.

When the amplifier section 2 is mounted to the ignition coil section 1, conductive coating 48 coated over the ignition coil section 1 comes in contact with the casing 10 and therefore the conductive coating 48 has a ground potential.

A name plate 4 made of good thermal conduction material such as aluminum is attached to the outside of the casing, covering the heads of the tapping screws 5. Stays 3 and 3' are fixed to the synthetic resin 44 of the ignition coil section 1 in such a way that washers 9 are inserted into the respective ends of a through-hole 1*a* and the stays 3 and 3' are fixedly coupled with the respective ends of the through-hole 1*a* by a screw 6, a spring washer 7 and a nut 8. The stays 3 and 3' are electrically connected, through washers 9 to the stiffening plates 33, the iron core 31 and the earth terminal 40*f* fastened to the iron core 31 by a screw and have a ground potential. As mentioned above, the lead wire 16' for earthing the amplifier 2 is fastened to the stay 3 by the screw 6.

As described above, the electronic circuit, or the integrated circuit 11 is disposed in the space enclosed by the casing 10 with good thermal conduction and the outer frame 45*a* of the mounting portion 45 in the amplifier section 2. With such a construction, when the ignition device gets wet, the integrated circuit 11 is protected from water. Therefore, a good water-proof of the ignition device is ensured. Additionally, a space between the mold outer surface of the ignition coil section 1 and the integrated circuit 11 at the mounting portion 45, impedes heat transfer of the heat emanating from the ignition coil 1 to the integrated circuit 11. Further, the integrated circuit 11 is mounted onto the casing 10 with good thermal conduction through the heat sink 11*a* so that heat emitting from the integrated circuit 11 is effectively radiated through the casing 10 to exterior. This minimizes temperature rise of the amplifier 2.

The invention which has been embodied just mentioned is similarly applicable to a miniature size amplifier using discrete elements for the electronic circuit, in addition to the integrated circuit in the above example.

The water-proof of the amplifier is further improved, when the fitting part between the projection 10*b* formed to the outer frame 10*d* of the casing 10 and the groove 45*c* formed in the outer frame 45*a* of the mounting portion 45 is additionally filled with bond or sealing material. Particularly, in this example, the structure for mounting the amplifier 2 onto the ignition coil section 1 employs the boss 45*b*, the hole 10*a*, and groove 45*c* and projection 10*b* both being disposed at the inner side beyond the screw 5. This structure prevents penetration of water through the screw part, thus further improving the water-proof.

Figure 9:
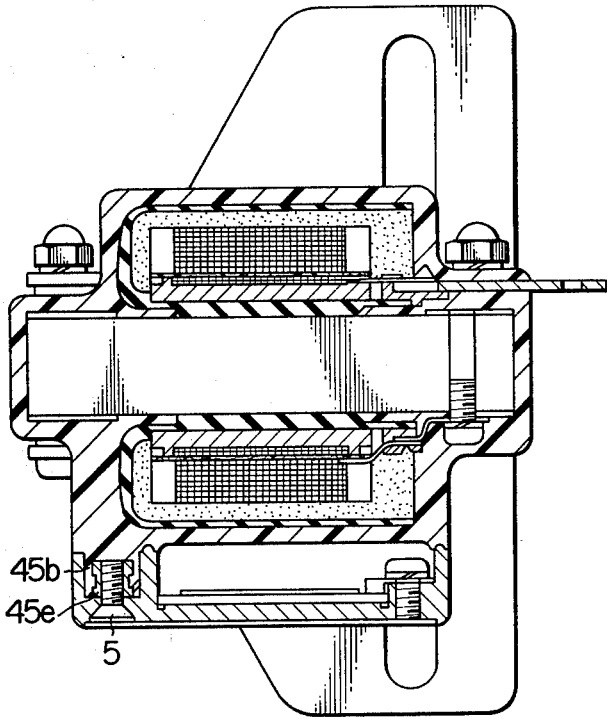
FIG. 9 shows in cross sectional form a modification of the ignition device in FIG. 1.

In another embodiment of the invention shown in FIG. 9, a nut 45*e* is buried in the boss 45*b*, unlike the embodiment mentioned above in which the screw 5 is directly screwed into the hole 45*d* of the boss 45*b*. This example is very effective when it is applied to a case where the resin is relatively soft and hence, when screw is directly screwed into the hole, insufficient strength is obtained. The remaining part of the embodiment is the same as the first embodiment, thus its elaboration is omitted.

As described above, the invention provides an ignition device for an internal combustion engine in which an amplifier section is mounted to an ignition coil section made of synthetic resin and its thermal stability is remarkably improved.

In the ignition device thus constructed, if the earth electrode 48 (shown in FIG. 5 as a conductive coating) is not used, the electronic circuit and the outermost surface, i.e. a high voltage part, and the synthetic resin are disposed in a facing relation. The electronic circuit section includes some sharp edges such as the tips of the terminal 19 and the lead wire 16 for connecting the electronic circuit section to the exterior circuit and the tips of the lead wires in the integrated circuit. Electric field is liable to concentrate around the tip and thus corona discharge also occurs therearound. Further, surge current is apt to rush thereinto. Therefore, unless the sharp edge portions connected to the electronic circuit section are sufficiently spaced apart from the high voltage part of the secondary coil 38, corona discharge occurs from the high voltage part of the secondary coil 38 toward the electronic circuit section, or when sparks occur at the ignition plug, intensive surge current rushes into the electronic circuit section. As a result, the ignition coil section 1 is dielectrically broken down, integrated circuit or semiconductor elements are broken or the device erroneously operates.

For this reason, when the small size amplifier section is attached to the ignition coil molded with synthetic resin as mentioned above, even if the amplifier is disposed close to the high voltage part of the ignition coil, care should be taken to avoid the occurrence of corona discharge and current surge in the amplifier due to spark discharge.

Provision of the earth electrode 48 prevents occurrence of corona discharge from the high voltage part of the ignition coil section. Disposition of the secondary coil around the primary coil prevents the surge current from flowing into the amplifier section when the spark discharge occurs. With this arrangement, a small size amplifier may be mounted to the ignition coil device of synthetic resin and the ignition device thus made is highly reliable.

As shown in FIG. 5, the conductive coating 48 coated over the ignition coil section 1 serves as an earth electrode, being disposed between the integrated circuit 11 or the terminal 19 see FIG. 8, and the high voltage part of the secondary coil 38. The integrated circuit 11 is shielded from the high voltage part of the secondary coil 38. The integrated circuit 11 accordingly is little affected by the secondary coil 38 even if the integrated circuit 11 is disposed close to the high voltage part. Further, the part provided with the coating 48 is flat in shape, and therefore the electric field between the high voltage part of the secondary coil 38 and the coating 48 is uniform, compared to that between the high voltage part of the secondary coil 38 and the integrated circuit 11 or the terminal 19. Thus, the maximum voltage value is considerably reduced with the result that it is difficult for the corona discharge to occur resulting in remarkable improvement of the withstand voltage performance of the ignition coil section 1, although the earth electrode 48 is disposed close to the integrated circuit 11 or terminal 19.

Figure 10:
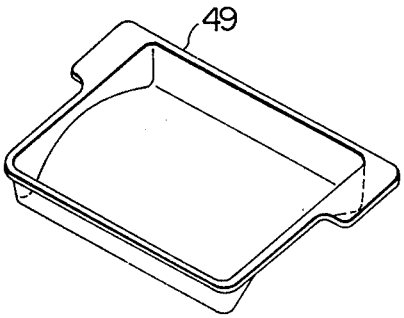
FIG. 10 shows a perspective view of an earth electrode which is preferably used in the invention.

In an example shown in FIG. 10, an electrode 49 is so shaped that the part of the electrode confronting the high voltage part of the secondary coil 38 is smoothly curved so as to eliminate tip-like portions.

As described above, with mere insertion of the earth electrode between the high voltage part of the ignition coil and the electronic circuit section of the amplifier, the adverse influence by the ignition coil upon the amplifier is eliminated without deterioration of the withstand voltage performance. With the disposition of the secondary coil around the primary coil, the amplifier may be attached close to the high voltage part of the ignition coil molded with synthetic resin. Therefore, the ignition device for the internal combustion engine according to the invention is small in size and high in reliability and productivity.

What is claimed is:

1. In a molded ignition device comprising:

an iron for forming a magnetic circuit;

a primary coil wound around said iron core;

a secondary coil wound around said iron core;

a high voltage terminal for withdrawing a high voltage;

a high voltage lead means for connecting said high voltage terminal to one end of said secondary coil;

a synthetic resin layer for covering said iron core and said primary and secondary high voltage terminals, electric fields being generated around the said coils;

a metal case with an outer frame;

integrated circuit means which is fixed at one surface to the inner surface of said metal case;

means forming a space between the other surface of said circuit means and the outer surface of said synthetic resin layer; and means for attaching said metal case to said synthetic resin layer, the improvement comprising:

means to substantially isolate the circuit means from said electric fields, said means comprising an earth electrode disposed between said outer surface of said synthetic layer and said space.

2. The device of claim 1, wherein said earth electrode comprises a conductive coating.

3. A molded ignition device comprising:

an iron core for forming a magnetic circuit;

a primary coil wound around said iron core for producing a magnetic flux in said magnetic circuit by magnetizing said iron core;

a secondary coil wound around said iron core and coupled to said magnetic flux for inducing a high voltage;

a high-voltage terminal for withdrawing said high voltage;

high-voltage lead means for connecting said high-voltage terminal to one end of said secondary coil;

an integrated circuit for controlling a current flowing into said primary coil;

a synthetic resin layer for covering said iron core, primary coil, high-voltage terminal and high-voltage lead means;

a recessed portion integrally molded with said synthetic resin layer and having a bottom surface which is larger than the size of said integrated circuit and an externally protruding portion on the periphery of said bottom surface by which said recessed portion is defined;

a metal casing having a flat bottom surface which is larger than the size of said integrated circuit and an externally protruding portion on the periphery of said flat bottom surface by which said metal casing is defined;

heat transferring means disposed in a space between the flat bottom surface of said metal casing and said integrated circuit so that heat emanated from said integrated circuit is transferred to said metal casing through the flat bottom surface of said metal casing;

means for fixing said integrated circuit to the flat bottom surface of said metal casing; and means for attaching said metal casing to said synthetic resin layer so that the externally protruding portion integrally molded with said synthetic resin layer is opposite to the externally protruding portion of said metal casing, thereby to provide a waterproofed chamber defined by the flat bottom surface of said metal casing and the bottom surface of said recessed portion integrally molded with said synthetic resin layer and to fix said integrated circuit in said waterproofed chamber.

4. A molded ignition device according to claim 3, said secondary coil being concentrically wound around said iron core around which said primary coil is wound and said high voltage terminal being disposed on the outer portion of said concentrically wound primary and secondary coils, wherein said recessed portion is an arc-shaped portion of said synthetic resin layer along said concentrically wound primary and secondary coils.

5. A molded ignition device according to claim 3, further comprising a metal plate disposed between said integrated circuit in said chamber and said bottom surface of said recessed portion for isolating said integrated circuit from the concentration of the electric field due to the high voltage induced in said secondary coil.

6. A molded ignition device according to claim 3, wherein said metal casing attaching means comprises externally projected portions integrally molded with said synthetic resin layer, threaded holes each formed in said projected portions and having depth which is shorter than the height thereof, screw holes formed in said metal casing and screws for fastening said metal casing to said synthetic resin layer with said screws being driven into said threaded holes through said screw holes formed in said metal casing.

7. A molded ignition device according to claim 3, wherein said metal casing attaching means comprises at least two externally projected portions integrally molded with said synthetic resin layer, said projected portions each being disposed on both sides of said recessed portion, threaded holes each formed in said projected portions and having depth which is shorter than the height of said projected portions, screw holes formed in said metal casing, said screw holes each being disposed on both sides of said flat bottom surface, and at least two screws for fastening said metal casing to said synthetic resin layer with said screws being driven in said threaded holes through said screw holes formed in said metal casing.

8. A molded ignition device according to claim 3, said secondary coil being concentrically wound around said primary coil, further comprising a conductive layer disposed between said integrated circuit and the bottom surface of said recessed portion for isolating said integrated circuit from the concentration of the electric field due to the high voltage induced in said secondary coil.

9. A molded ignition device according to claim 3, said secondary coil being concentrically wound around said primary coil, wherein said metal-casing attaching means comprises at least two externally projected portions integrally molded with said synthetic resin layer, said projected portions each being disposed on both sides of said recessed portion, threaded holes each formed in said projected portions and having depth which is shorter than the height of said projected portions, screw holes formed in said metal casing at positions between which said flat bottom surface of said metal casing is disposed so as to be opposite to said screw holes formed in said projected portions, and screws for fastening said metal casing to said synthetic resin layer with the screws being driven into the threaded holes of said projected portions through the holes formed in said metal casing.

10. A molded ignition device comprising:

an iron core for forming a magnetic circuit;

a primary coil wound around said iron core for producing a magnetic flux in said magnetic circuit by magnetizing said iron core;

a secondary coil wound around said iron core and coupled to said magnetic flux for inducing a high voltage;

a high-voltage terminal for withdrawing said high voltage;

a high-voltage lead means for connecting the high voltage terminal to one end of said secondary coil;

an integrated circuit for controlling a current flowing into said primary coil;

a synthetic resin layer for covering said iron core, primary coil, secondary coil, high-voltage terminal and high-voltage lead means;

a recessed portion integrally molded with said synthetic resin layer and having a first bottom surface which is larger than the size of said integrated circuit, a second bottom surface disposed adjacent to said first bottom surface, and an externally protruding portion on the outer periphery of said first and second bottom surfaces by which said recessed portion is defined;

a metal casing having a flat surface which is larger than the size of said integrated circuit for covering said first and second bottom surfaces;

means for attaching said metal casing to said synthetic resin layer so that the externally protruding portion integrally molded with said synthetic resin layer is opposite to the externally protruding portion of said metal casing, thereby to provide a first waterproofed chamber defined by the flat surface of said metal casing and said first bottom surface and a second waterproofed chamber defined by the flat surface of said metal casing and said second bottom surface;

means for fixing said integrated circuit to the flat surface of said metal casing which is opposite to said first bottom surface so that heat emanated from said integrated circuit is transferred to said metal casing through said flat surface;

a plurality of conductors connected to said integrated circuit at one end and taken out of said first chamber through said second chamber for delivering the input and output currents of said integrated circuit; and a partition wall disposed between said first and second chambers for supporting said plural conductors and keeping said first chamber waterproofed from said second chamber.

11. A molded ignition device according to claim 10, further comprising a conductive metal plate disposed between said integrated circuit and the first bottom surface for isolating said integrated circuit from the concentration of the electric field due to the high voltage induced in said secondary coil.

12. A molded ignition device according to claim 11, wherein said metal casing attaching means comprises at least two externally projected portions integrally molded with said synthetic resin layer, said projected portions each being disposed on both sides of said first bottom surface, threaded holes each formed in said projected portions and having depth which is shorter than the height of said projected portions, screw holes formed in said metal casing at positions between which said flat bottom surface is disposed, and at least two screws for fastening said metal casing to said synthetic resin layer with said screws being driven into the threaded holes of said projected portions through the holes formed in said metal casing.

13. A molded ignition device according to claim 12, further comprising a name plate made of thermally conductive material, said name plate being disposed outside of said metal casing so as to cover the heads of said screw holes formed in said metal casing and said screws for waterproofing.

* * * * *